US008581814B2

(12) United States Patent
Chen et al.

(10) Patent No.: US 8,581,814 B2
(45) Date of Patent: Nov. 12, 2013

(54) METHOD FOR DRIVING PIXELS OF A DISPLAY PANEL

(75) Inventors: Po-Yang Chen, Taipei County (TW); Po-Sheng Shih, Taipei County (TW); Tsu-Chiang Chang, Taipei County (TW)

(73) Assignee: Hannstar Display Corporation, New Taipei City (TW)

( * ) Notice: Subject to any disclaimer, the term of this patent is extended or adjusted under 35 U.S.C. 154(b) by 1038 days.

(21) Appl. No.: 12/145,511

(22) Filed: Jun. 25, 2008

(65) Prior Publication Data

US 2009/0102820 A1 Apr. 23, 2009

(30) Foreign Application Priority Data

Oct. 17, 2007 (TW) ..... 96138841 A

(51) Int. Cl.
*G09G 3/36* (2006.01)

(52) U.S. Cl.
USPC ..... 345/87

(58) Field of Classification Search
USPC ..... 345/87
See application file for complete search history.

(56) References Cited

U.S. PATENT DOCUMENTS

| | | | | |
|---|---|---|---|---|
| 5,923,310 | A * | 7/1999 | Kim | 345/90 |
| 5,940,055 | A * | 8/1999 | Lee | 345/87 |
| 2005/0134539 | A1 * | 6/2005 | Jang | 345/92 |
| 2007/0018939 | A1 * | 1/2007 | Chen et al. | 345/100 |

FOREIGN PATENT DOCUMENTS

TW 200705372 2/2007

OTHER PUBLICATIONS

"Office Action of Taiwan Counterpart Application", issued on Jun. 18, 2012, p. 1-p. 11, in which the listed references were cited.

* cited by examiner

*Primary Examiner* — Jonathan Boyd
(74) *Attorney, Agent, or Firm* — Jianq Chyun IP Office

(57) ABSTRACT

A method for driving pixels of a display panel is provided. The display panel includes a first gate line coupled to a gate of a first-switch transistor, wherein a source of the first-switch transistor is coupled to a liquid crystal capacitor and a first-storage capacitor. The liquid crystal capacitor includes a pixel electrode and a common electrode. A terminal of the first-storage capacitor is coupled to a second gate line. First, a first modulation signal is provided to the common electrode. Next, the first-switch transistor is turned on by the first gate line. Next, a second modulation signal is provided to the second gate line after the first-switch transistor is turned on. Wherein, the second modulation signal enables a second-switch transistor coupled to the second gate line to operate in the cut-off region. And the first and second modulation signals are in phase.

23 Claims, 12 Drawing Sheets

METHOD FOR DRIVING PIXELS OF A DISPLAY PANEL

CROSS-REFERENCE TO RELATED APPLICATION

This application claims the priority benefit of Taiwan application serial no. 96138841, filed on Oct. 17, 2007. The entirety of the above-mentioned patent application is hereby incorporated by reference herein and made a part of this specification.

BACKGROUND OF THE INVENTION

1. Field of the Invention

The present invention generally relates to a driving method, and more particularly, to a method for driving pixels of a display panel.

2. Description of Related Art

FIG. 1 is a diagram illustrating a structure of a pixel which comprises a pixel structure with Cst on common. In FIG. 1, label 101 and label 102 represent a Nth gate line and a (N−1)th gate line in a display panel, respectively, wherein N is a natural number. And label 103 and label 104 all represent a source line, and label 105 represents a thin film transistor (TFT), and label 106 represents a pixel electrode, and label 107 represents a common line. In the structure, a portion of the pixel electrode 106 is overlapped with a portion of the common line 107 so as to form a storage capacitor Cst as shown in FIG. 2. FIG. 2 is a schematic diagram illustrating a structure in which the portion of the pixel electrode 106 is overlapped with the portion of the common line 107. Accordingly, the structure as shown in FIG. 1 is a pixel structure with Cst on common.

The pixel structure with Cst on common is widely used in various small-size display panels, and in the pixel structure, the common voltage modulation means that a modulation voltage source is used as a common voltage to drive the pixel, so as to lower the output voltage range of a source driver and decrease the cost of the source driver. However, because the pixel structure comprises the common line, an aperture ratio of the structure is smaller such that resolution, image quality and power consumption of the display panel are all undesired. Therefore, a display panel which comprises a pixel structure with a large aperture ratio to overcome the shortcomings of the conventional display panel is desired. However, when the display panel is fabricated by the pixel structure with a large aperture ratio, and the modulation voltage source is used as the common voltage to drive the pixel, when using the conventional gate line driving method (i.e. a pulse is provided to gate lines in turn, so as to turn on pixels coupled to the gate lines in turn), the quality of the image is decreased because of the inconsistent brightness shown when the pixel is turned off. The cause will be described as follows.

FIG. 3 is a diagram illustrating another structure of a pixel which comprises a pixel structure with Cst on gate. In FIG. 3, label 301 and label 302 represent a Nth gate line and a (N−1)th gate line in a display panel, respectively. And label 303 and label 304 represent two adjacent source lines, and label 305 represents a thin film transistor (TFT), and label 306 represents a pixel electrode. In the structure, there is no a common line, such that the aperture ratio of the structure is higher. In addition, in the structure, a portion of the pixel electrode 306 is overlapped with a portion of the gate line 302 so as to form a storage capacitor Cst as shown in FIG. 4. FIG. 4 is a schematic diagram illustrating a structure in which the portion of the pixel electrode 306 is overlapped with the portion of the gate line 302. Accordingly, the structure as shown in FIG. 3 is a pixel structure with Cst on gate. The pixel structure of Cst on gate have a higher aperture ratio than that of Cst on common. However, the Cst on gate structure with common voltage modulation Vcom results in the inconsistent brightness between periods of common voltage high and common voltage low. The cause will be described as follows.

FIG. 5 is a diagram illustrating an equivalent circuit of the structure as shown in FIG. 3. In FIG. 5, the labels 301-305 represent the corresponding elements as shown in FIG. 3, and Vcom represents a common voltage formed by a modulation voltage source (i.e. a potential of a common electrode of the substrate opposite to the TFT array substrate, hereinafter, called as a modulation common voltage Vcom), and Vp represents a voltage on the pixel electrode 306, and Clc represents a capacitor composed of the pixel electrode 306, the common electrode (not shown) and the liquid crystal layer between the pixel electrode 306 and the common electrode.

FIG. 6 is a diagram illustrating a signal waveform when the circuit as shown in FIG. 5 is used in the Kth image, wherein K is a natural number. Refer to FIG. 5 and FIG. 6, when a pulse 601 is provided to the gate line 301 so as to turn on the TFT 305, because a voltage of data loaded into the liquid capacitor Clc through the source line 303 is larger than a voltage of the modulation common voltage Vcom, during the TFT 305 is turned on, a level of the voltage Vp is pulled up, such that the brightness of the pixel is shown according to the voltage difference between the modulation common voltage Vcom and the voltage Vp. However, when the pulse 601 is turned to a low voltage from a high voltage, the TFT 305 is turn off to float the pixel electrode 306, such that the voltage Vp is vary because the variation of the modulation common voltage Vcom couples to the pixel electrode through the storage capacitor Cst. And in theory, the voltage Vp varies as shown in the line 603.

As shown in the dotted line 602 which represents the variation of the voltage Vp, even if the TFT 305 is turned off, if the voltage difference between the voltage Vcom and the voltage Vp is still unchanged, the brightness of the pixel will be fixed. However, in this case, a $\Delta Vp$ of the voltage Vp is smaller than a $\Delta Vcom$ of Vcom, such that the voltage Vp may mostly be pulled up to the level shown as label 603 in FIG. 6. Accordingly, when the pixel is turned off, the brightness is inconsistent between periods of common voltage high and common voltage low to decrease the average brightness which may be perceived by human eye.

FIG. 7 is a diagram illustrating a signal waveform when the circuit as shown in FIG. 5 is used in the (K+1)th image. Refer to FIG. 5 and FIG. 7, when a pulse 701 is provided to the gate line 301 so as to turn on the TFT 305, because a voltage of data loaded into the liquid capacitor Clc through the source line 303 is smaller than a voltage of the modulation common voltage Vcom, during the TFT 305 is turned on, a level of the voltage Vp is pulled down. However, when the TFT 305 is turned off to float the pixel electrode 306, such that the voltage Vp is vary because the variation of modulation common voltage Vcom couples to the pixel electrode through the storage capacitor Cst. And in theory, the voltage Vp varies as shown by a dotted line 702, however, in practice, the voltage Vp is pulled down to the level shown as label 703. Accordingly, when the pixel is turned off, the brightness is inconsistent between periods of common voltage high and common voltage low to decrease the average brightness which may be perceived by the human eye. Accordingly, although the pixel structure with Cst on gate has a higher aperture ratio, the brightness of the pixel is still decreased when the pixel is driven by the modulation common voltage Vcom.

FIG. 8 is a diagram illustrating another structure of a pixel. In FIG. 8, label 801 and label 802 represent a Nth gate line and a (N−1)th gate line, respectively. And label 803 and label 804 represent two adjacent source lines, and label 805 represents a thin film transistor (TFT), and label 806 represents a pixel electrode. In the structure, a portion of the pixel electrode 806 is overlapped with a portion of the gate line 802, a portion of the source line 803 and a portion of the source line 804 (the structure may increase the aperture ratio of the pixel) to form a parasitic capacitor Cg1, a parasitic capacitor Cd1 and a parasitic capacitor Cd2 besides a storage capacitor Cst. FIG. 9 is a diagram illustrating an equivalent circuit of the structure shown in FIG. 8. In FIG. 9, the labels 801-805, Cst, Cg1, Cd1 and Cd2 represent the corresponding elements as shown in FIG. 8, and Vcom represents a modulation common voltage, and Vp represents a voltage on the pixel electrode 806, and Clc represents a liquid capacitor between the pixel electrode 806 and the common electrode (not shown).

As described above, in the structure as shown in FIG. 8, after the TFT is turned off, because of the parasitic capacitors, the voltage variation value ΔVp of the voltage Vp is also not equal to the voltage variation value ΔVcom of the modulation common voltage Vcom. Accordingly, when the pixel is turned off, the brightness is inconsistent to decrease the average brightness which may be perceived by human eye.

FIG. 10 is a diagram illustrating another structure of a pixel, and the structure is one of the above-said specific structures. In FIG. 10, numerals 1001 and 1002 represent a Nth gate line and a (N−1)th gate line, respectively. And numerals 1003 and 1004 represent two adjacent source lines, and numeral 1005 represents a thin film transistor (TFT), and numeral 1006 represents a pixel electrode, and numeral 1007 represents a common line on the substrate of the TFT. In the structure, a portion of the pixel electrode 1006 is overlapped with a portion of the gate line 1001, a portion of the gate line 1002, a portion of the source line 1003 and a portion of the source line 1004 (the structure may increase the aperture ratio of the pixel) to form a parasitic capacitor Cg1, a storage capacitor Cst1, a parasitic capacitor Cd1 and a parasitic capacitor Cd2. In addition, a portion of the pixel electrode 1006 is also overlapped with a portion of the common line 1007 to form a storage capacitor Cst2 as shown in FIG. 11. FIG. 11 is a schematic diagram illustrating a structure in which the portion of the pixel electrode 1006 is overlapped with the portion of the common line 1007.

FIG. 12 is a diagram illustrating an equivalent circuit of the structure shown in FIG. 10. In FIG. 12, the numerals 1001-1007, Cg1, Cst1, Cd1 and Cd2 represent the corresponding elements as shown in FIG. 10, and Vcom represents a modulation common voltage, and Vp represents a voltage on the pixel electrode 1006, and Clc represents a liquid capacitor between the pixel electrode 1006 and the common electrode (not shown). In addition, the storage capacitor Cst2 is also described in FIG. 12. As described above, in the structure as shown in FIG. 10, after the TFT is turned off, because of these parasitic capacitors, the voltage variation value ΔVp of the voltage Vp is also not equal to the voltage variation value ΔVcom of the modulation common voltage Vcom. The voltage difference between Vp and Vcom don't keep a constant value. Accordingly, the brightness when the pixel is turned on and after the pixel is turned off may be inconsistent to decrease the average brightness which may be perceived by the human eye.

SUMMARY OF THE INVENTION

Accordingly, the present invention is directed to a method for driving a display panel which may overcome the shortcoming of the prior art described above and thereby increase image quality.

The present invention is also directed to a method for driving pixels of a display panel. The display panel comprises a first gate line coupled to a gate of a first-switch transistor, wherein a source of the first-switch transistor is coupled to a liquid crystal capacitor and a first-storage capacitor. The liquid crystal capacitor is composed of a pixel electrode and a common electrode, and a terminal of the first-storage capacitor is coupled to a second gate line. The method may be described as follows. First, a first modulation signal is provided to the common electrode. Next, the first-switch transistor is turned on by the first gate line. Next, a second modulation signal is provided to the second gate line after the first-switch transistor is turned on. Wherein, the second modulation signal enables a second-switch transistor coupled to the second gate line to operate in the cut-off region. And the first and second modulation signals are in phase with each other.

The present invention is also directed to a method for driving pixels of a display panel, wherein the display panel comprises a plurality of gate lines. The method is described as follows. First, a switch transistor coupled to a Nth gate line is turned on through the Nth gate line, and a source of the switch transistor is coupled to a (N−1)th gate line through a pixel electrode and a storage capacitor, and is coupled to a common electrode through the pixel electrode and a liquid crystal capacitor, and the common electrode is coupled to a modulation signal, wherein N is a natural number. Next, after the switch transistor is turned on, a first-predetermined voltage and a second-predetermined voltage are in turn provided to the (N−1)th gate line, so as to provide in turn a first-coupling voltage and a second-coupling voltage to the pixel electrode. Wherein, the first-predetermined voltage and the second-predetermined voltage may enable a second-switch transistor coupled to the (N−1)th gate line to operate in a cut-off region, and the conversion time of the first-predetermined voltage and the second-predetermined voltage is synchronized with the voltage modulation time.

In an embodiment of the present invention, the voltage variation value of the second modulation signal is larger than or equal to the voltage variation value of the first modulation signal.

In an embodiment of the present invention, the second modulation signal comprises at least the first-predetermined voltage and the second-predetermined voltage.

In an embodiment of the present invention, the voltage difference between the first-predetermined voltage and the second-predetermined voltage is larger than or equal to the voltage variation value of the first modulation signal.

The present invention may provide the modulation signal to the second gate line after the switch transistor coupled to the first gate line is turned on through the first gate line, so as to provide the coupling voltage to the pixel electrode through the storage capacitor between the second gate line and the pixel electrode coupled to the switch transistor. Wherein, the modulation signal enables the switch transistor coupled to the second gate line to operate in the cut-off region of the transistor, and the modulation signal and the common potential are in phase with each other. Accordingly, the voltage variation value of the voltage Vp may be compensated by adjusting the voltage difference of the predetermined voltages provided by the modulation signal so as to enable the voltage variation value of the voltage Vp to be equal to the voltage variation value of the modulation common potential Vcom. Thus, the possibility of the problem due to the phenomenon of brightness inconsistency perceived by the human eye when the pixel is turned on and after the pixel is turned off may be effectively reduced. Therfore, image quality may be effectively promoted.

These and other exemplary embodiments, features, aspects, and advantages of the present invention will be described and become more apparent from the detailed description of exemplary embodiments when read in conjunction with accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

For the purpose of illustrating the present invention, the liquid crystal display panels are assumed to comprise pixels have the conventional configurations.

Figure 1:
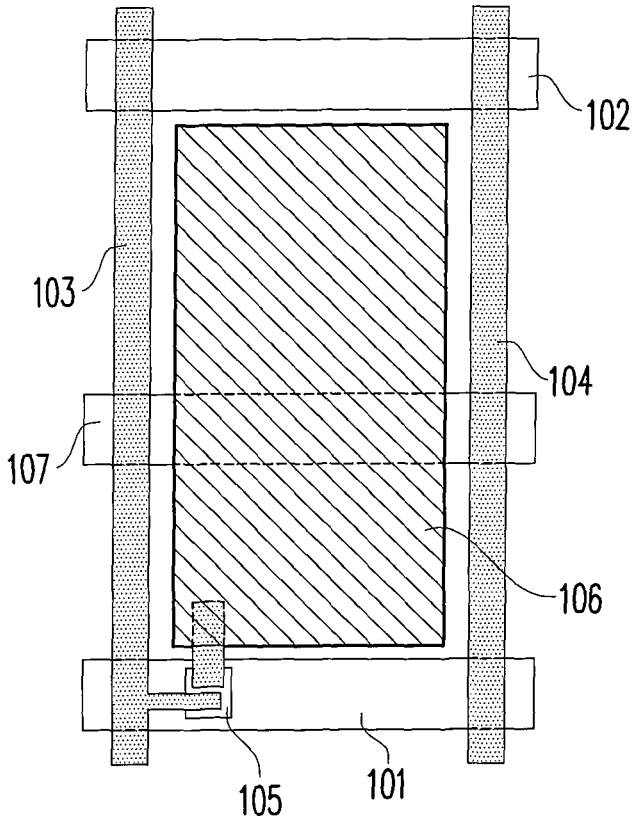
FIG. 1 (PRIOR ART)
FIG. 1 is a diagram illustrating a structure of a conventional pixel.
Figure 2:
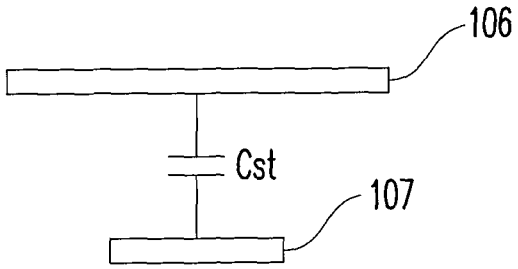
FIG. 2 (PRIOR ART)
FIG. 2 is a schematic diagram illustrating a structure in which the portion of the pixel electrode 106 is overlapped with the portion of the common line 107 in FIG. 1.
Figure 3:
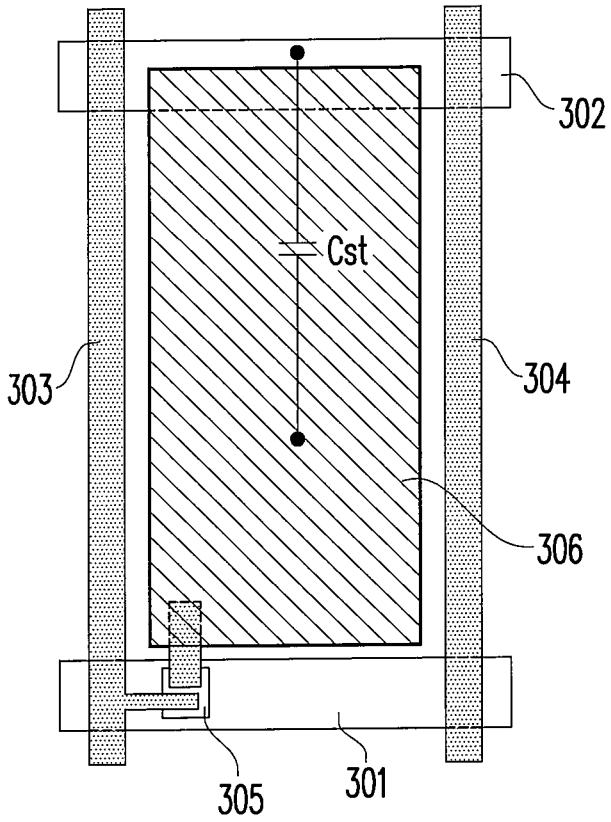
FIG. 3 (PRIOR ART)
FIG. 3 is a diagram illustrating a structure of another conventional pixel.
Figure 4:
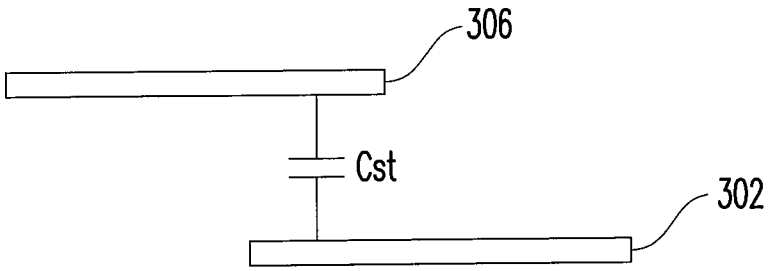
FIG. 4 (PRIOR ART)
FIG. 4 is a schematic diagram illustrating a structure in which the portion of the pixel electrode 306 is overlapped with the portion of the gate line 302 in FIG. 3.
Figure 5:
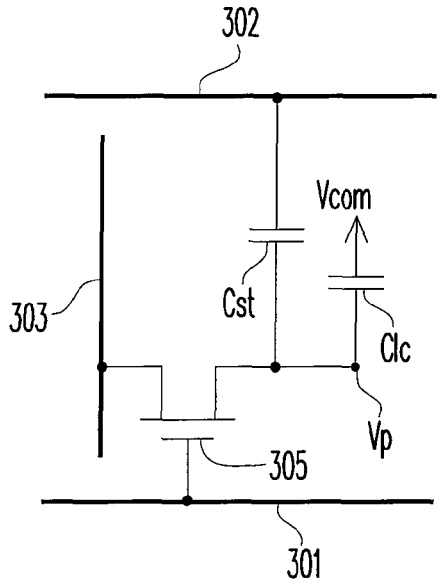
FIG. 5 (PRIOR ART)
FIG. 5 is a diagram illustrating the equivalent circuit of the structure as shown in FIG. 3.
Figure 6:
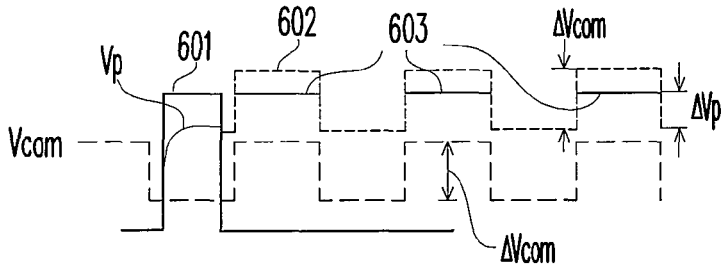
FIG. 6 (PRIOR ART)
FIG. 6 is diagram illustrating a signal waveform when the circuit as shown in FIG. 5 is used in the Kth image.
Figure 7:
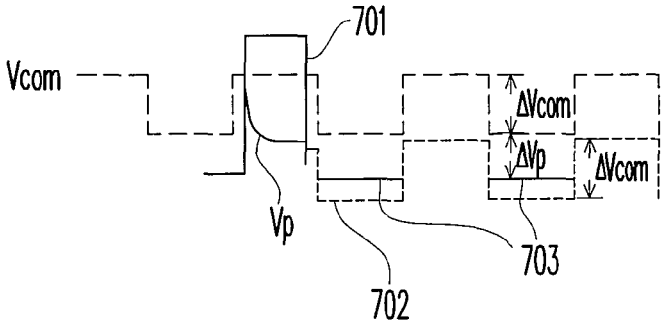
FIG. 7 (PRIOR ART)
FIG. 7 is diagram illustrating a signal waveform when the circuit as shown in FIG. 5 is used in the (K+1)th image.
Figure 13:
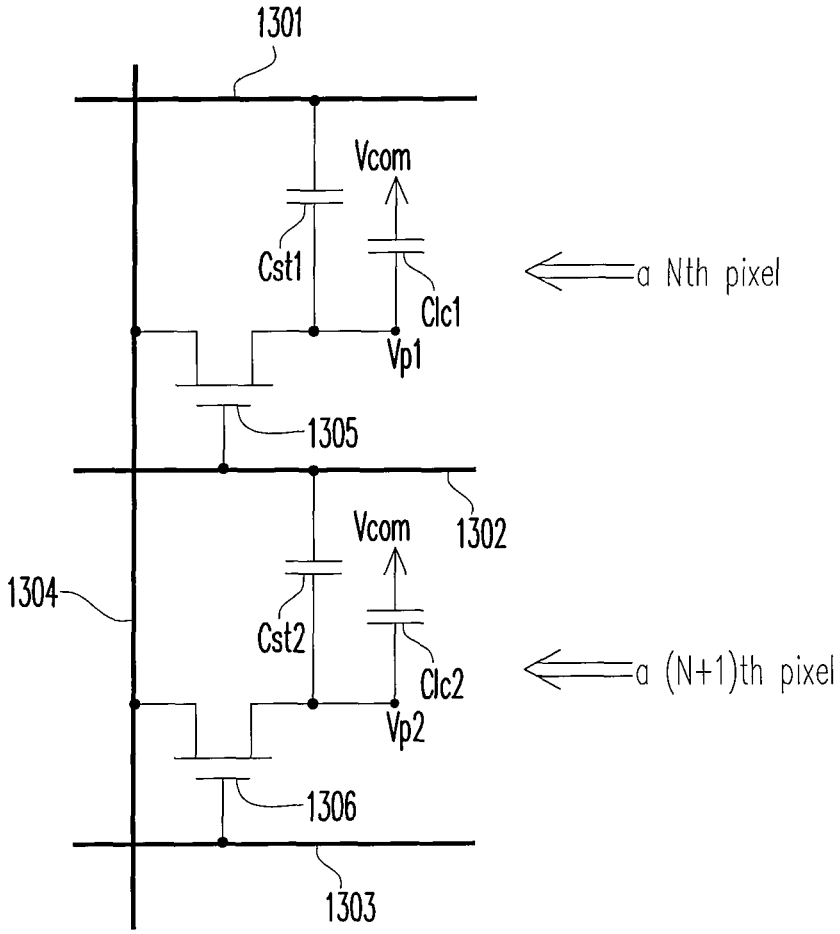
FIG. 13 is diagram illustrating the equivalent circuit of the two adjacent pixels which use the structure in FIG. 3.

When the pixels in a display panel have the configuration as shown in FIG. 3, the equivalent circuit of two adjacent pixels of the display panel may be as in FIG. 13. FIG. 13 is diagram illustrating the equivalent circuit of the two adjacent pixels having the structure shown in FIG. 3, and the two pixels are labelled as a Nth pixel and a (N+1)th pixel, wherein N is a natural number. In FIG. 13, numerals 1301, 1302 and 1303 represent a (N−1)th gate line, Nth gate line and (N+1) gate line, respectively. And numeral 1304 represents a source line, numerals 1305 and 1306 represent a switch transistor. Cst1 represents a storage capacitor between the pixel electrode of the Nth pixel and the gate line 1301, and a terminal of the storage capacitor Cst1 is coupled to the gate line 1301, and its another terminal is coupled to a source of the switch transistor 1305. Label Vp1 represents a voltage on the pixel electrode of the Nth pixel, and label Clc1 represent a liquid crystal capacitor between the pixel electrode of the Nth pixel and a common electrode (not shown). And Cst2 represents a storage capacitor between the pixel electrode of the (N+1)th pixel and the gate line 1302, and a terminal of the storage capacitor Cst2 is coupled to the gate line 1302, and its another terminal is coupled to a source of the switch transistor 1306. Reference Vp2 represents a voltage on the pixel electrode of the (N+1)th pixel, and Clc2 represents a liquid crystal capacitor between the pixel electrode of the (N+1)th pixel and the common electrode. The switch transistors comprise thin film transistors, however the present invention is not limited thereto as such.

Figure 14:
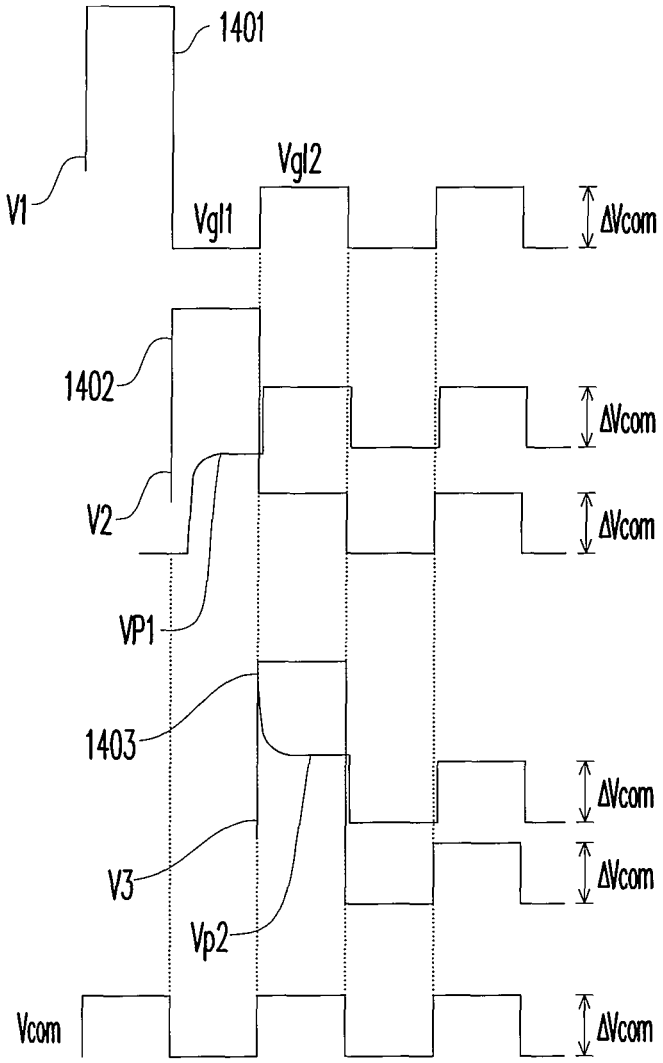
FIG. 14 is diagram illustrating a signal waveform of the Kth image according to an embodiment of the present invention.
Figure 15:
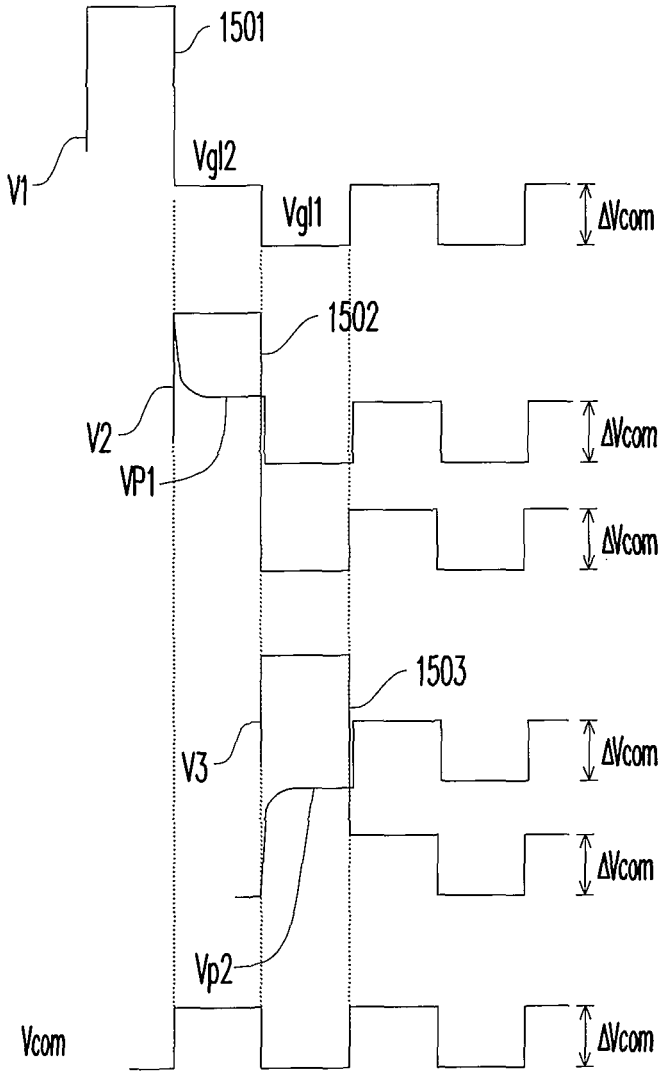
FIG. 15 is diagram illustrating a signal waveform of the (K+1)th image according to an embodiment of the present invention.

As shown in FIG. 14 and FIG. 15, a signal on the gate line is changed. FIG. 14 is a diagram illustrating a signal waveform of the Kth image according to an embodiment of the present invention, wherein K is a natural number. Refer to FIG. 14, labels V1, V2 and V3 respectively represent signal waveforms on the gate lines 1301, 1302 and 1303, and labels 1401, 1402 and 1403 in the three signal waveforms respectively represent a pulse for turning on the switch transistors connected to the gate lines. After the pulses, signals on the three gate lines all swing between the voltage Vp1 and the voltage Vp2, the signals are the modulation signals provided to the gate lines. And label Vcom represent a waveform of the modulation common voltage, that is, the waveform presented by the modulation signal is provided to the common electrode.

Refer to FIG. 14, after the pulse 1401 of the gate line signal V1, the gate line signal V1 always swings between the predetermined voltage Vgl 1 and the predetermined voltage Vg12. Likewise, after the pulse 1402 of the gate line signal V2 (i.e. the gate line signal V2 is in the enabled state), the gate line signal V2 always swings between the predetermined voltage Vgll and the predetermined voltage Vg12 (i.e. the gate line signal V2 is in the disabled state), and after the pulse 1403 of the gate line signal V3 (i.e. the gate line signal V3 is in the enabled state), the gate line signal V3 always swings between the predetermined voltage Vgl 1 and the predetermined voltage Vg12 (i.e. the gate line signal V3 is in the disabled state). However, the predetermined voltages Vgll and Vg12 are all smaller than the enabled voltage of the switch transistor connected to the gate line, that is, the predetermined voltages Vgll and Vg12 bias the switch transistor connected to the gate line to operate in the cut-off region of the transistor (the cut-off region will be described hereinafter). In addition, the conversion time of the predetermined voltages Vgl 1 and Vg12 is synchronized with the modulation time of the modulation common voltage Vcom. Furthermore, it is clearly seen that, in FIGS. 13 to 14, the switch transistor 1306 coupled to the gate line 1303 is turned on in response to the pulse 1403 of the gate line signal V3 after the switch transistor 1305 coupled to the gate line 1302 is turned on in response to the pulse 1402 of the gate line signal V2.

Refer to FIG. 13 and FIG. 14, when the pulse 1402 is provided to the gate line 1302 so as to turn on the switch transistor 1305, and because a voltage of data loaded into the liquid capacitor Clc1 through the source line 1304 is higher than a voltage of the modulation common voltage Vcom, a level of the voltage Vp1 is pulled up, such that the brightness of the pixel correspond to the voltage difference between the modulation common voltage Vcom and the voltage Vp1. Next, when the pulse 1402 is turned to a low potential from a high potential, the switch transistor 1305 is turned off to float the pixel electrode of the Nth pixel, however, in the meantime, the predetermined voltages Vgl1 and Vgl2 are also in turn provided on the gate line 1301 to transmit in turn two coupling voltages to the pixel electrode corresponding to the voltage Vp1 through the storage capacitor Cst1, so as to effect the voltage variation value ΔVp1. Accordingly, the voltage variation value ΔVp1 may be described by the following equation (1):

$$\Delta Vp1=[Clc1/(Cst1+Clc1)]\Delta Vcom+[Cst1/(Cst1+Clc1)]\Delta Vgl \quad (1)$$

, wherein ΔVgl represents the voltage difference between the predetermined voltage Vgl1 and the predetermined voltage Vgl2. In the equation (1), if ΔVgl=ΔVcom, then ΔVp1=ΔVcom, that is, if ΔVgl=ΔVcom, after the switch transistor 1305 is turned off, the voltage difference between the modulation common voltage Vcom and the voltage VP1 remains unchanged, so as to overcome the shortcoming of the inconsistent brightness of the pixel caused by the coupling of the voltage variation on the modulation common voltage Vcom when the switch transistor is turned off.

When the pulse 1403 is provided to the gate line 1303 so as to turn on the switch transistor 1306, because a voltage of data loaded into the liquid capacitor Clc2 through the source line 1304 is smaller than a voltage of the modulation common voltage Vcom, during the on state of the switch transistor 1306, a level of the voltage Vp2 is pulled down, such that the brightness of the pixel corresponds to the voltage difference between the modulation common voltage Vcom and the voltage Vp2. Next, when the pulse 1403 is turned to a low potential from a high potential, the switch transistor 1306 is turned off to float the pixel electrode of the (N+1)th pixel. However, in the meantime, the predetermined voltages Vgl1 and Vgl2 are in turn provided to the gate line 1302 to transmit in turn two coupling voltages to the pixel electrode corresponding to the voltage Vp2 through the storage capacitor Cst2, so as to effect the voltage variation value ΔVp2. Because the storage capacitor Cst1 is equal to Cst2, Clc1 is also equal to Clc2, accordingly, the voltage variation value ΔVp2 may be described as a formula (1).

Likewise, in the Kth image, for other pixels coupled to the gate lines 1302 and 1303 through the switch transistors and pixels coupled to other gate lines through the switch transistor. Thus, the possibility of the problem of inconsistent in the brightness when the pixel is turned off is effectively solved.

Likewise, for the (K+1)th image, the signal on the gate line is also changed. FIG. 15 is a diagram illustrating a signal waveform of the (K+1)th image according to an embodiment of the present invention. Refer to FIG. 15, references V1, V2 and V3 respectively represent signal waveforms on the gate lines 1301, 1302 and 1303, and the waveforms of the voltage Vp1, the voltage Vp2 and the modulation common voltage Vcom are all described. And in FIG. 15, 1501, 1502 and 1503 respectively represent a pulse for turning on the switch transistors connected to the gate lines.

Refer to FIG. 15, after the pulse 1501 of the gate line signal V1, the gate line signal V1 always swings between the predetermined voltage Vgl1 and the predetermined voltage Vgl2. Likewise, after the pulse 1502 of the gate line signal V2, the gate line signal V2 always swings between the predetermined voltage Vgl1 and the predetermined voltage Vgl2, and after the pulse 1503 of the gate line signal V3, the gate line signal V3 always swings between the predetermined voltage Vgl1 and the predetermined voltage Vgl2, and the conversion time of the predetermined voltages Vgl1 and Vgl2 is synchronized with the modulation time of the modulation common voltage Vcom. In practice, the polarity of voltage applied to the liquid crystal layer needs to be inverted alternately to prevent the liquid crystal from being polarized, such that in the (K+1)th image, the voltage on the data transmitted to the liquid crystal coupled to the same gate line and the polarity relation between the data voltage and the modulation common voltage Vcom are different from those of the Kth image. However, based on the theory of the operation method as shown in FIG. 14, the method as shown in FIG. 15 is used to the (K+1)th image to resolve the problem of inconsistent in the brightness when the pixel is turned off.

Figure 8:
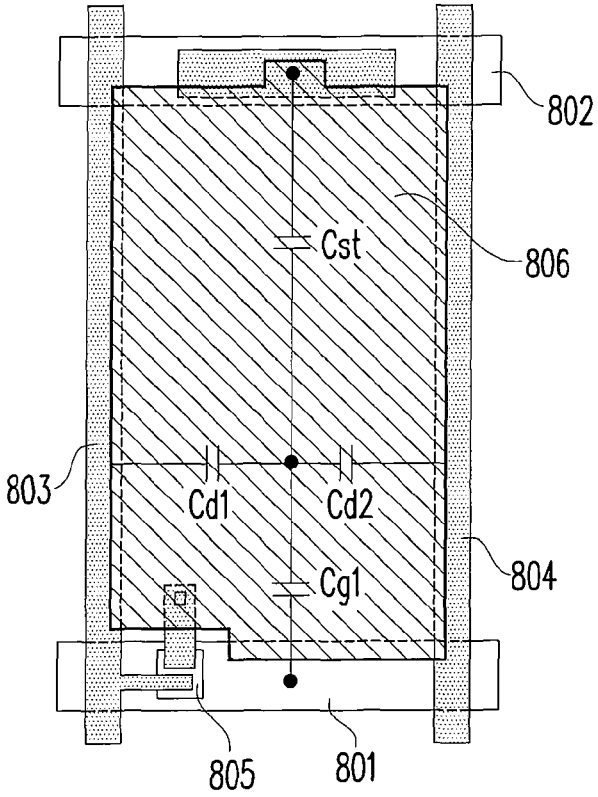
FIG. 8 (PRIOR ART)
FIG. 8 is a diagram illustrating a structure of a pixel according to an embodiment of the present invention.
Figure 9:
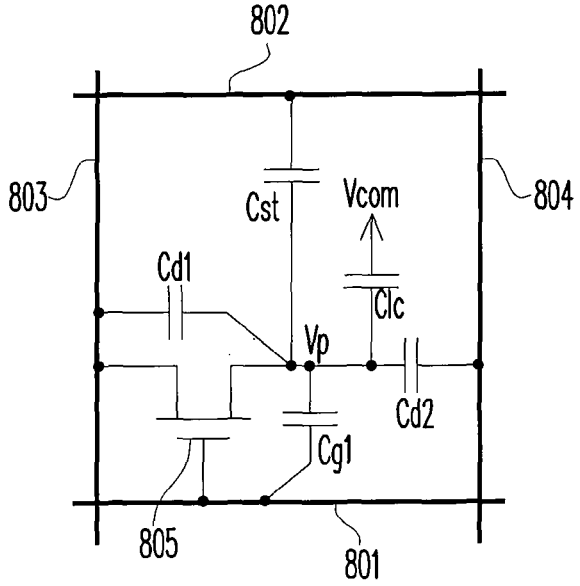
FIG. 9 (PRIOR ART)
FIG. 9 is a diagram illustrating the equivalent circuit of the structure as shown in FIG. 8.
Figure 16:
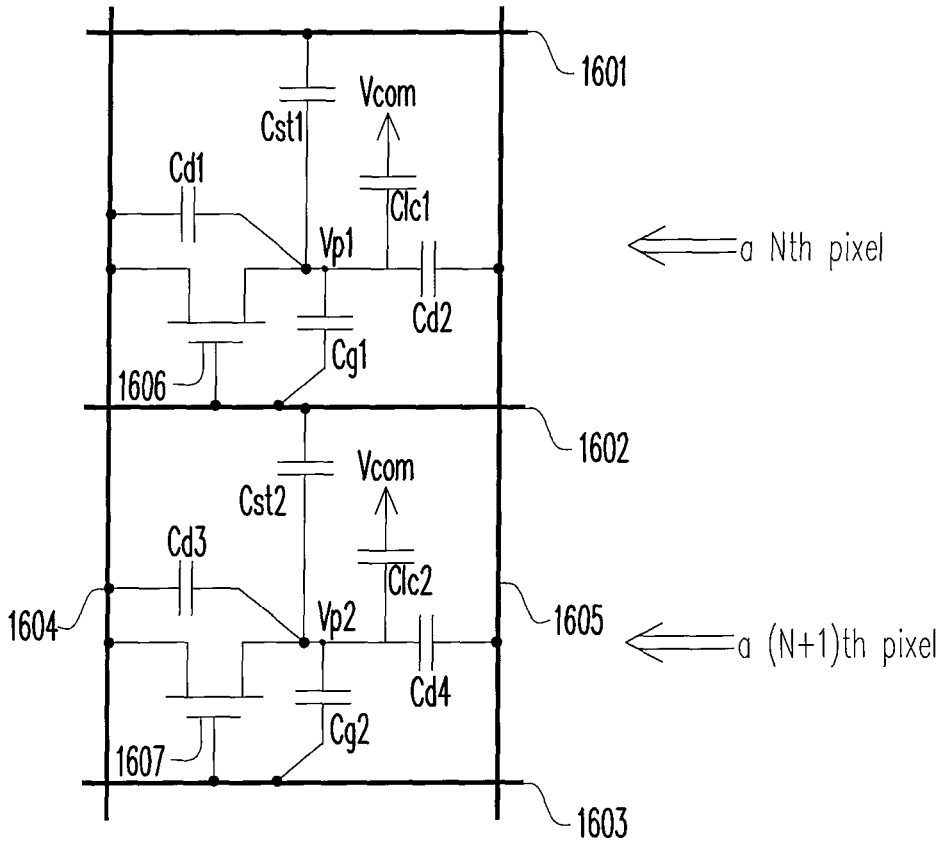
FIG. 16 is diagram illustrating the equivalent circuit of the two adjacent pixels which use the structure in FIG. 8.

When the pixels in a display panel comprises the structure shown in FIG. 8, the equivalent circuit of the two adjacent pixels of the display panel may be as shown in FIG. 16. FIG. 16 is diagram illustrating the equivalent circuit of the two adjacent pixels using the structure in FIG. 8, and the two pixels are referenced as a Nth pixel and a (N+1)th pixel, wherein N is a natural number. And in FIG. 16, numerals 1601, 1602 and 1603 represent a (N−1)th gate line, Nth gate line and (N+1) gate line, respectively. And numerals 1604 and label 1605 represent two adjacent source lines, and numerals 1606 and 1607 represent switch transistors.

In addition, in FIG. 16, Cst1 represents a storage capacitor between the pixel electrode of the Nth pixel and the gate line 1601, and a terminal of the storage capacitor Cst1 is coupled to the gate line 1601, and its another terminal is coupled to a source of the TFT 1606. Vp1 represents a voltage on the pixel electrode of the Nth pixel, and Clc1 represent a liquid crystal capacitor between the pixel electrode of the Nth pixel and a common electrode (not shown), and reference Cg1 represents a parasitic capacitor between the pixel electrode of the Nth pixel and the gate line 1602, and Cd1 represents a parasitic capacitor between the pixel electrode of the Nth pixel and the source line 1604, and Cd2 represents a parasitic capacitor between the pixel electrode of the Nth pixel and the source line 1605. And Cst2 represents a storage capacitor between the pixel electrode of the (N+1)th pixel and the gate line 1602, and a terminal of the storage capacitor Cst2 is coupled to the gate line 1602, and its another terminal is coupled to a source of the TFT 1607. Vp2 represents a voltage on the pixel electrode of the (N+1)th pixel, and Clc2 represent a liquid crystal capacitor between the pixel electrode of the (N+1)th pixel and the common electrode, and Cg2 represents a parasitic capacitor between the pixel electrode of the (N+1)th pixel and the gate line 1603, and Cd3 represents a parasitic capacitor between the pixel electrode of the (N+1)th pixel and the source line 1604, and Cd4 represents a parasitic capacitor between the pixel electrode of the (N+1)th pixel and the source line 1605.

The equivalent circuit as shown in FIG. 16 may also be operated by using the methods as described in FIG. 14 and FIG. 15. Accordingly, the voltage variation value ΔVp1 of the voltage Vp1 in FIG. 16 is expressed by the following equation (2):

$$\Delta Vp1=[Clc1/(Cst1+Clc1+Cb1)]\Delta Vcom+[Cst1/(Cst1+Clc1+Cb1)]\Delta Vgl \quad (2),$$

wherein, ΔVgl represents the voltage difference between the predetermined voltage Vgl1 and the predetermined voltage Vgl2, and Cb1=Cg1+Cd1+Cd2. In the equation (2), if ΔVgl=ΔVcom, then ΔVgl=[(Cst1+Cb1)/Cst1]ΔVcom. Such that, the shortcoming of the inconsistent brightness of the pixel caused by the coupling of the voltage variation on the modulation common voltage Vcom during the switch transistor is turned off is overcome. And the storage capacitor Cst1 is equal to the storage capacitor Cst2, and the Clc1 is equal to the Clc2, and the Cd1 is equal to the Cd3, and the Cd2 is equal to the Cd4, and the Cg1 is equal to the Cg2, such that the voltage variation value ΔVp2 of the voltage Vp2 may be expressed by the equation (2). Likewise, the shortcoming of the inconsistent brightness of the pixel caused by the coupling of the voltage variation on the modulation common voltage Vcom during the switch transistor is turned off is overcome by adjusting the voltage difference between the predetermined voltage Vgl1 and Vgl2.

Figure 10:
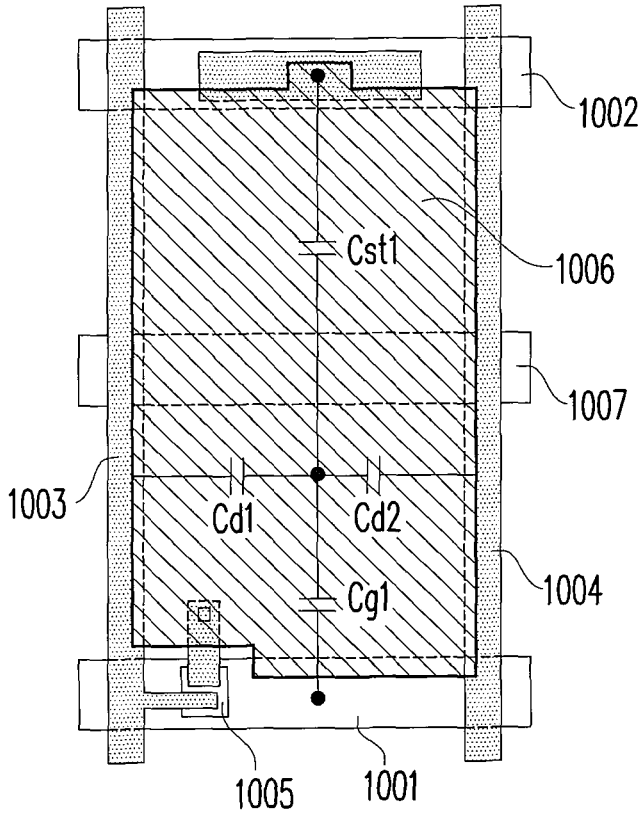
FIG. 10(PRIOR ART)
FIG. 10 is a diagram illustrating a structure of a pixel according to an embodiment of the present invention.
Figure 11:
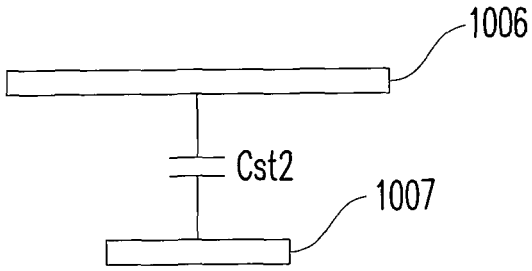
FIG. 11(PRIOR ART)
FIG. 11 is a schematic diagram illustrating structure in which the portion of the pixel electrode 1006 is overlapped with the portion of the common line 1007 in FIG. 10.
Figure 12:
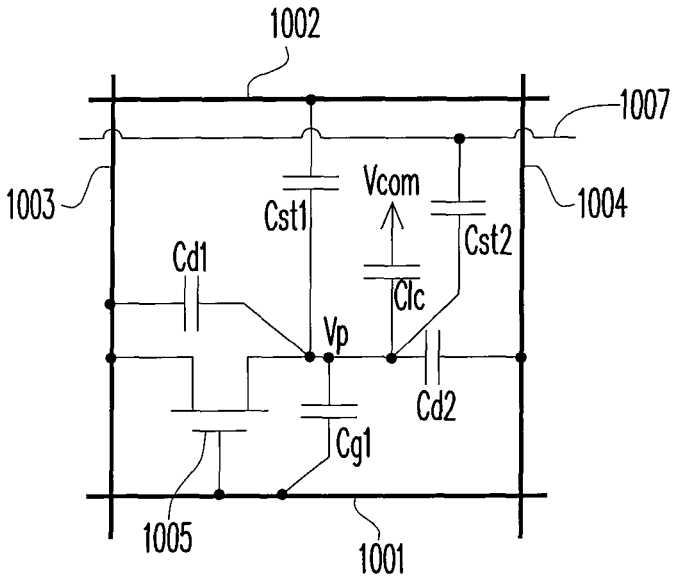
FIG. 12(PRIOR ART)
FIG. 12 is a diagram illustrating the equivalent circuit of the structure as shown in FIG. 10.
Figure 17:
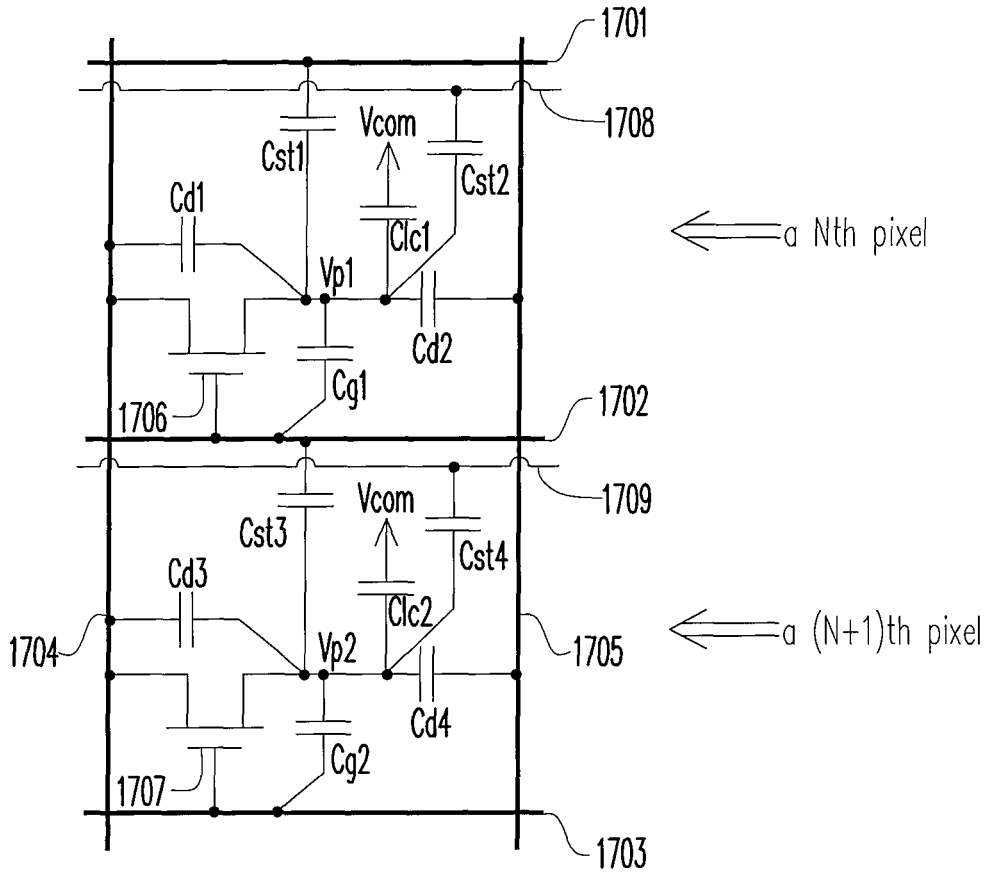
FIG. 17 is diagram illustrating the equivalent circuit of the two adjacent pixels which use the structure in FIG. 10.

When the pixels in a display panel comprise the structure shown in FIG. 10, the equivalent circuit of the two adjacent pixels of the display panel is as shown in FIG. 17. FIG. 17 is diagram illustrating the equivalent circuit of the two adjacent pixels using the structure in FIG. 10, and the two pixels are referenced as a Nth pixel and a (N+1)th pixel, wherein N is a natural number. And in FIG. 17, numerals 1701, 1702 and 1703 represent a (N−1)th gate line, Nth gate line and (N+1) gate line, respectively. And numerals 1704 and 1705 represent two adjacent source lines, and numerals 1706 and 1707 represent switch transistors, and numerals 1708 and 1709 respectively represent the common line of the Nth pixel and the common line of the (N+1)th pixel.

In addition, in FIG. 17, Cst1 represents a storage capacitor between the pixel electrode of the Nth pixel and the gate line 1701, and a terminal of the storage capacitor Cst1 is coupled to the gate line 1701, and its another terminal is coupled to a source of the TFT 1706. And Cst2 represents a storage capacitor between the pixel electrode of the Nth pixel and the common line 1708, and a terminal of the storage capacitor Cst2 is coupled to the common line 1708. and its another terminal is coupled to a source of the TFT 1706. Vp1 represents a voltage on the pixel electrode of the Nth pixel, and reference Clc1 represent a liquid crystal capacitor between the pixel electrode of the Nth pixel and a common electrode (not shown), and Cg1 represents a parasitic capacitor between the pixel electrode of the Nth pixel and the gate line 1702, and Cd1 represents a parasitic capacitor between the pixel electrode of the Nth pixel and the source line 1704, and label Cd2 represents a parasitic capacitor between the pixel electrode of the Nth pixel and the source line 1705. Cst3 represents a storage capacitor between the pixel electrode of the (N+1)th pixel and the gate line 1702, and a terminal of the storage capacitor Cst3 is coupled to the gate line 1702, and its another terminal is coupled to a source of the TFT 1707. And Cst4 represents a storage capacitor between the pixel electrode of the (N+1)th pixel and the common line 1709, and a terminal of the storage capacitor Cst4 is coupled to the common line 1709, and the other terminal is coupled to a source of the TFT 1707. Vp2 represents a voltage on the pixel electrode of the (N+1)th pixel, and Clc2 represent a liquid crystal capacitor between the pixel electrode of the (N+1)th pixel and the common electrode, and Cg2 represents a parasitic capacitor between the pixel electrode of the (N+1)th pixel and the gate line 1703, and Cd3 represents a parasitic capacitor between the pixel electrode of the (N+1)th pixel and the source line 1704, and Cd4 represents a parasitic capacitor between the pixel electrode of the (N+1)th pixel and the source line 1705.

The equivalent circuit shown in FIG. 17 is operated by using the methods as described in FIG. 14 and FIG. 15. If the voltage on the common line is equal to the modulation common voltage Vcom, the voltage variation value ΔVp1 of the voltage Vp1 may be expressed by the following equation (3):

$$\Delta Vp1 = [(Clc1 + Cst2)/(Cst2 + Clc1 + Cb1 + Cst1)]\Delta Vcom + [Cst1/(Cst2 + Clc1 + Cb1 + Cst1)]\Delta Vgl \quad (3)$$

wherein ΔVgl represents the voltage difference between the predetermined voltage Vgl1 and the predetermined voltage Vgl2, and Cb1=Cg1+Cd1+Cd2. If ΔVgl=ΔVcom, then ΔVgl=[(Cst1+Cb1)/Cst1]ΔVcom. Such that, the shortcoming of the inconsistent brightness of the pixel caused by the coupling of the voltage variation on the modulation common voltage Vcom during the switch transistor is turned off is resolved. And the storage capacitor Cst1 is equal to the storage capacitor Cst2, and the Clc1 is equal to the Clc2, and the Cd1 is equal to the Cd3, and the Cd2 is equal to the Cd4, and the Cg1 is equal to the Cg2, and the Cst2 is equal to the Cst4, such that the voltage variation value ΔVp2 of the voltage Vp may also be described as a formula ( 3). Likewise, the shortcoming of the inconsistent brightness of the pixel caused by the coupling of the voltage variation on the modulation common voltage Vcom during the switch transistor is turned off is overcome by adjusting the voltage difference between the predetermined voltage Vgl1 and Vgl2.

In the embodiments described above, in order to correspond to the two voltage levels of the modulation common voltage Vcom, the modulation signal provided to various gate lines has only two predetermined voltages. Accordingly, if the modulation common voltage Vcom has a plurality of voltage levels in order to comply with the actual need, the number of the predetermined voltage the modulation signal provided to various gate lines may be increased. In summary, the modulation signal provided to the gate line should be synchronized with the modulation common voltage Vcom. In order to increase the effect, the voltage variation value of the modulation signal provided to the gate line must be larger than or equal to the voltage variation value of the modulation common voltage Vcom, that is, the voltage variation value of the modulation signal provided to the gate line must be larger than or equal to the voltage variation value of the modulation signal provided to the common electrode. In addition, in order to improve the circuit design, the modulation signal may be provided before the pulse of the signal on the gate line which may be use for turning on the switch transistor. It is noted that a portion of the gate line may be used as one of the electrodes of the storage capacitor, and an electrode plate or a conduction plate may be configured on the gate line to be used as one of the electrodes of the storage capacitor.

Figure 18:
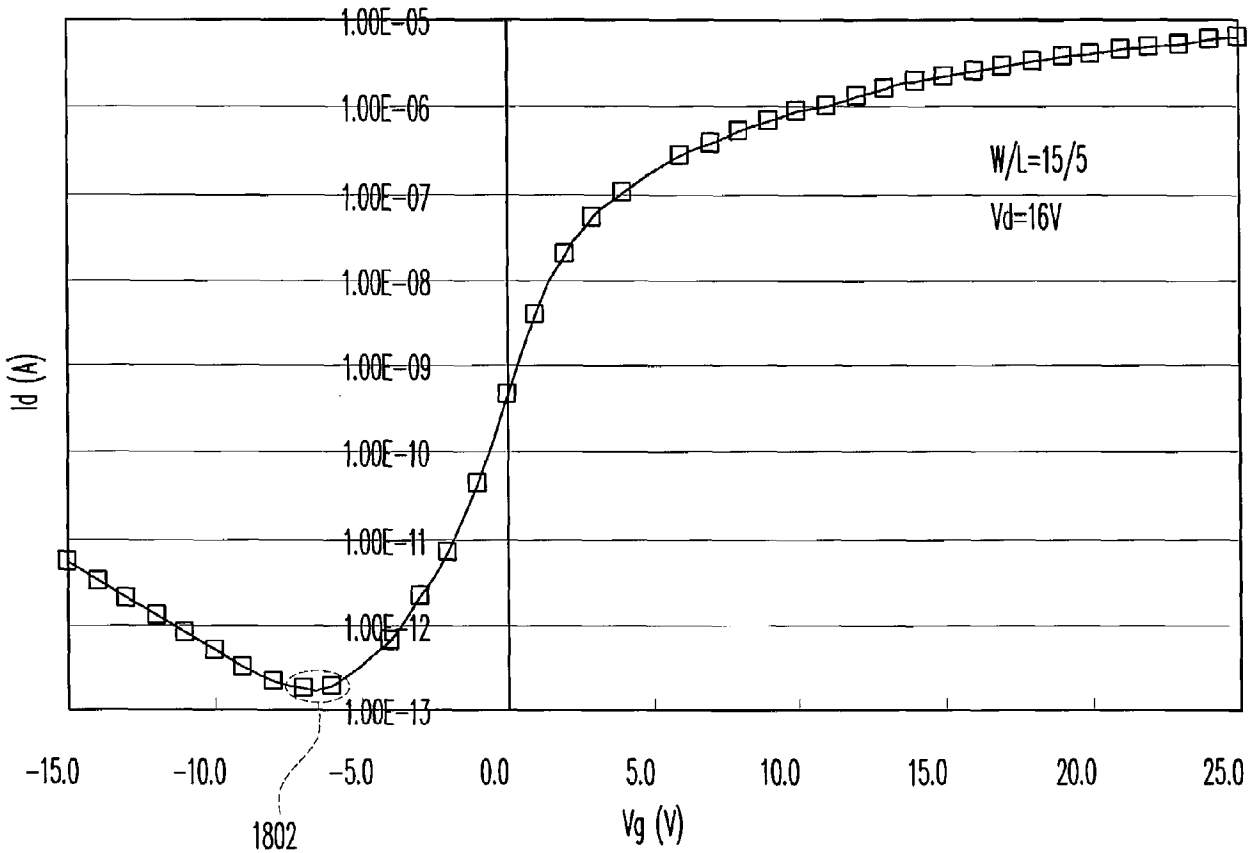
FIG. 18 is diagram illustrating the Vg-Id characteristic curve of a thin film transistor.

In addition, the cut-off region of the transistor may be described as follows by using the characteristic curve of a thin film transistor. FIG. 18 is diagram illustrating the Vg-Id characteristic curve of a thin film transistor. Refer to FIG. 18, Vg and Id respectively represent the voltage on the gate and the current of the drain of the thin film transistor. In FIG. 18, the drain of the thin film transistor may be biased at 16V to obtain the Vg-Id characteristic curve, wherein the width of the channel of the thin film transistor is 15 μm and the length of the channel of the thin film transistor is 5 μm (i.e. W/L=15/5). Numeral 1802 represents the inversion point of the operation of the thin film transistor, and the right region of the inversion point 1802 is the conduction region of the transistor, and the left region of the inversion point 1802 is the cut-off region of the transistor. In the present invention, the modulation signal provided to the gate line must enable the thin film transistor to operate in the cut-off region in the left of the inversion point 1802.

Figure 19:
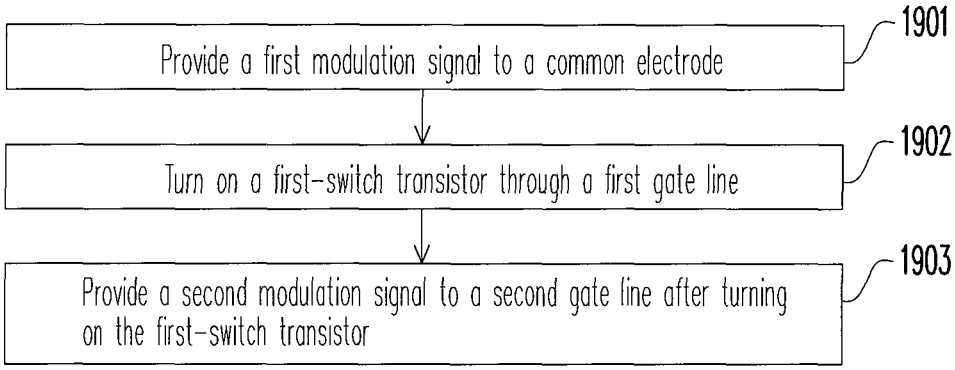
FIG. 19 is diagram illustrating a flowchart of a method for driving a display panel according to an embodiment of the present invention.

The above embodiments described above explain the theory of the present invention. FIG. 19 is a diagram illustrating a flowchart of a method for driving a display panel according to an embodiment of the present invention. Referring to FIG. 19, first, a first modulation signal is provided to a common electrode. Next, a first-switch transistor is turned on through a first gate line. Next, after the first-switch transistor is turned on, a second modulation signal is provided to a second gate line. Wherein, the second modulation signal enables a second-switch resistor coupled to the second gate line to operate in the cut-off region. And the first and the second modulation signal are in phase.

The present invention may provide the modulation signal to the second gate line after the switch transistor coupled to the first gate line is turned on through the first gate line, so as to transmit the coupling voltage to the pixel electrode through the storage capacitor between the second gate line and the pixel electrode coupled to the switch transistor. Wherein, the modulation signal enables the switch transistor coupled to the second gate line to operate in the cut-off region of the transistor, and the modulation signal and the common voltage are in phase with each other. Accordingly, the voltage variation value of the voltage Vp is compensated by adjusting the voltage difference of the predetermined voltages provided by the modulation signal so as to enable the voltage variation value of the voltage Vp to be equal to the voltage variation value of the modulation common voltage Vcom, such that the problem of the inconsistent brightness when the pixel is turned off is resolved. Therefore, the image quality may be effectively promoted.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method for driving pixels of a display panel, the display panel comprising a first gate line coupled to a gate of a first-switch transistor, and a source of the first-switch transistor coupled to a liquid crystal capacitor and a first-storage capacitor, the liquid crystal capacitor comprising a pixel electrode and a common electrode, and a terminal of the first-storage capacitor coupled to a second gate line, the method comprising:

providing a first modulation signal to the common electrode;

turning on the first-switch transistor via the first gate line after a second-switch transistor coupled to the second gate line is turned on; and providing a second modulation signal to the second gate line while the first-switch transistor is turned on, so as to make a disabled state of a signal on the second gate line continuously vary between two different levels, and the second-switch transistor coupled to the second gate line is operated in a cut-off region in response to the two different levels, wherein the first modulation signal is synchronized with the second modulation signal, wherein a voltage variation value of a pixel electrode voltage corresponding to the second-switch transistor is substantially equal to a voltage variation value of a voltage on the common electrode and maintains the same voltage variation value of the voltage on the common electrode at any given time, wherein a voltage variation value of a pixel electrode voltage corresponding to the first-switch transistor is substantially equal to the voltage variation value of the voltage on the common electrode and maintains the same voltage variation value of the voltage on the common electrode at any given time.

2. A method for driving pixels of a display panel according to claim 1, wherein the second modulation signal comprises at least a first-predetermined voltage and a second-predetermined voltage.

3. A method for driving pixels of a display panel according to claim 1, wherein the second modulation signal provides a first-predetermined voltage and a second-predetermined voltage in turn.

4. A method for driving pixels of a display panel according to claim 1, wherein an electrode of the first-storage capacitor comprises a portion of the second gate line.

5. A method for driving pixels of a display panel according to claim 2, further comprising:

transmitting a data voltage to the pixel electrode during turning on the first-switch transistor through the first gate line, and providing the first-predetermined voltage to the second gate line when the data voltage is greater than a voltage of the common electrode, wherein the first-predetermined voltage is smaller than the second-predetermined voltage.

6. A method for driving pixels of a display panel according to claim 5, further comprising:

turning off the first-switch transistor through the first gate line after turning on the first-switch transistor, and providing a third modulation signal to the first gate line.

7. A method for driving pixels of a display panel according to claim 6, wherein the third modulation signal comprises the first-predetermined voltage and the second-predetermined voltage, and the second-predetermined voltage is firstly provided to the first gate line.

8. A method for driving pixels of a display panel according to claim 6, further comprising:

turning on a third-switch transistor coupled to a third gate line through the third gate line while turning off the first-switch transistor; and providing a fourth modulation signal to the third gate line while turning off the third-switch transistor through the third gate line.

9. A method for driving pixels of a display panel according to claim 8, wherein the fourth modulation signal comprises the first-predetermined voltage and the second-predetermined voltage, and the first-predetermined voltage is firstly provided to the third gate line.

10. A method for driving pixels of a display panel according to claim 6, further comprising:

turning on the second-switch transistor coupled to the second gate line through the second gate line before turning on the first-switch transistor through the first gate line.

11. A method for driving pixels of a display panel according to claim 1, wherein a voltage variation value of the second modulation signal is greater than or equal to a voltage variation value of the first modulation signal.

12. A method for driving pixels of a display panel according to claim 2, further comprising:

transmitting a data voltage to the pixel electrode during turning on the first-switch transistor through the first gate line; and providing the second-predetermined voltage to the second gate line when the data voltage is smaller the voltage of the common electrode, wherein the first-predetermined voltage is smaller than the second-predetermined voltage.

13. A method for driving pixels of a display panel according to claim 12, further comprising:

turning off the first-switch transistor through the first gate line after turning on the first-switch transistor; and providing a third modulation signal to the first gate line.

14. A method for driving pixels of a display panel according to claim 13, wherein the third modulation signal comprises the first-predetermined voltage and the second-predetermined voltage, and the first-predetermined voltage is firstly provided to the first gate line.

15. A method for driving pixels of a display panel according to claim 12, further comprising:

turning on a third-switch transistor coupled to a third gate line through the third gate line while turning off the first-switch transistor; and providing a fourth modulation signal to the third gate line while turning off the third-switch transistor through the third gate line.

16. A method for driving pixels of a display panel according to claim 15, wherein the fourth modulation signal comprises the first-predetermined voltage and the second-predetermined voltage, and the second-predetermined voltage is firstly provided to the third gate line.

17. A method for driving pixels of a display panel according to claim 1, wherein the source of the first-switch transistor is coupled to a common line through a second-storage capacitor.

18. A method for driving pixels of a display panel according to claim 2, wherein a voltage difference between the first-predetermined voltage and the second-predetermined voltage is greater than or equal to a voltage variation value of the first modulation signal.

19. A method for driving pixels of a display panel, wherein the display comprises a plurality of gate lines, wherein the method comprises:

turning on a first-switch transistor coupled to an Nth gate line through the Nth gate line after a second-switch transistor coupled to an (N−1)th gate line is turned on, wherein a source of the first-switch transistor is coupled to the (N−1)th gate line through a pixel electrode and a storage capacitor, and is coupled to a common electrode through the pixel electrode and a liquid crystal capacitor, and the common electrode is coupled to a modulation signal, wherein N is a natural number; and providing alternately a first-predetermined voltage and a second-predetermined voltage to the (N−1)th gate line while turning on the first switch transistor, so as to make a disabled state of a signal on the (N-t)th gate line continuously vary between two different levels and thus provide alternately a first-coupling voltage and a second-coupling voltage to the pixel electrode through the storage capacitor, wherein, the second-switch transistor coupled to the (N−1) th gate line is operated in a cut-off region in response to the two different levels, and a conversion time of the first-predetermined voltage and the second-predetermined voltage is synchronized with a voltage modulation time of the modulation signal, wherein a voltage variation value of a pixel electrode voltage corresponding to the second-switch transistor is substantially equal to a voltage variation value of a voltage on the common electrode and maintains the same voltage variation value of the voltage on the common electrode at any given time, wherein a voltage variation value of a pixel electrode voltage corresponding to the first-switch transistor is substantially equal to the voltage variation value of the voltage on the common electrode and maintains the same voltage variation value of the voltage on the common electrode at any given time.

20. A method for driving pixels of a display panel according to claim 19, further comprising:

transmitting a data signal to the pixel electrode when turning on the first-switch transistor through the Nth gate line, and providing firstly the first-predetermined voltage to the (N−1)th gate line when the data voltage is greater than the voltage of the common electrode, wherein the first-predetermined voltage is smaller than the second-predetermined voltage.

21. A method for driving pixels of a display panel according to claim 19, wherein a voltage difference between the first-predetermined voltage and the second-predetermined voltage is greater than or equal to the voltage variation value of the modulation signal.

22. A method for driving pixels of a display panel according to claim 19, further comprising:

transmitting a data signal to the pixel electrode when turning on the first-switch transistor through the Nth gate line; and providing firstly the second-predetermined voltage to the (N−1)th gate line when the data voltage is smaller than the voltage of the common electrode, wherein the first-predetermined voltage is smaller than the second-predetermined voltage.

23. A method for driving pixels of a display panel according to claim 22, wherein a voltage difference between the first-predetermined voltage and the second-predetermined voltage is greater than or equal to the voltage variation value of the modulation signal.

* * * * *